US007214074B2

(12) United States Patent
Osada

(10) Patent No.: US 7,214,074 B2
(45) Date of Patent: May 8, 2007

(54) ELECTRICAL CONNECTOR WITH A TINE PLATE

(75) Inventor: Tsuyoshi Osada, Farmington Hills, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/018,781

(22) Filed: Dec. 21, 2004

(65) Prior Publication Data

US 2006/0134975 A1 Jun. 22, 2006

(51) Int. Cl.
*H01R 12/00* (2006.01)

(52) U.S. Cl. ..... 439/79; 439/892

(58) Field of Classification Search ..... 439/79, 439/80, 541.5, 892

See application file for complete search history.

(56) References Cited

U.S. PATENT DOCUMENTS 5,382,168 A * 1/1995 Azuma et al. ..... 439/65
5,690,513 A * 11/1997 Fink et al. ..... 439/567
5,797,768 A * 8/1998 Francaviglia ..... 439/567
5,827,076 A 10/1998 Chen
6,062,877 A 5/2000 Makino et al.
6,773,272 B2 * 8/2004 Koehler et al. ..... 439/79
6,863,549 B2 * 3/2005 Brunker et al. ..... 439/108
6,866,552 B2 * 3/2005 Koehler ..... 439/892
2003/0166348 A1 9/2003 Martin et al.
2003/0176086 A1 9/2003 Ogawa
2005/0085109 A1 * 4/2005 Tanaka et al. ..... 439/79

FOREIGN PATENT DOCUMENTS

WO WO-02/082584 A2 10/2002
WO WO-02/082584 A3 10/2002

OTHER PUBLICATIONS

International Search Report issued for International application No. PCT/US2005/044507 mailed on Apr. 3, 2006, 4 pages.

* cited by examiner

*Primary Examiner*—Thanh-Tam Le
(74) *Attorney, Agent, or Firm*—Osha Liang LLP

(57) ABSTRACT

A connector includes a housing and a terminal portion disposed on the housing. A tine plate has a first surface, an oppositely facing second surface, a plurality of through-holes passing from the first surface to the second surface, and at least one opening passing from the first surface to the second surface. A plurality of tines are disposed on the terminal portion. Each tine extends through a corresponding one of the through holes in a direction from the first surface toward the second surface. At least one protrusion is disposed on the housing, extending at least partially through the respective at least one opening in the direction from the first surface toward the second surface. The at least one protrusion engages the tine plate along a perimeter of the at least one opening at two or more contact points.

20 Claims, 7 Drawing Sheets

ELECTRICAL CONNECTOR WITH A TINE PLATE

BACKGROUND OF INVENTION

1. Field of the Invention

The invention relates in general to electrical connectors for mounting on a printed circuit board, and in particular to an electrical connector with a tine plate for receiving a plurality of tines of the connector.

2. Background Art

A "right angle header" type connector is conventionally known in the art for mounting to a printed circuit board. A right angle type connector typically comprises a plurality of tines in series having an inverted "L" shape, such that the plurality of tines generally extend horizontally from a back surface of a body or housing of the connector and bend at a right angle in a direction toward the printed circuit board. In the right angle type connector, some tines are longer than others, potentially reducing their strength. This affects alignment accuracy when mounting the connector to the printed circuit board, and the tines may be prone to deformation during transport. Accordingly, a reinforcing member, commonly referred to as a tine plate, is often used to ensure alignment accuracy and to prevent deformation of the tines. The tine plate has a plurality of through-holes for receiving the plurality of tines, thereby protecting the tines. The tine plate is typically secured by a locking mechanism provided on the connector body.

Some clearance between the tine plate and the connector housing is necessary to ensure functionality of the locking mechanism, taking into account design tolerances and so forth. Because of the clearance, however, even though the tine plate is held by the locking mechanism, the tine plate tends to vibrate and percussively contact the tines and/or the connector body. One drawback is that abnormal noise may emanate from the connector. To reduce or eliminate the noise, movement of the tine plate needs to be restricted in three dimensions.

Merely installing an additional locking mechanism undesirably increases complexity of the connector. By contrast, if there is no clearance in the locking mechanism, excessive interference between the connector body and the tine plate will cause the tine plate to be torsionally or laterally deformed. Accordingly, displacement between the through-holes of the tine plate and receiving holes of the print circuit board may occur. Such displacement can cause insertion failure, and defective soldering when mounting the connector to the printed circuit board, as well as solder cracking due to thermal expansion.

SUMMARY OF INVENTION

According to one aspect of the invention, a connector includes a housing and a terminal portion disposed on the housing. A tine plate has a first surface, an oppositely facing second surface, a plurality of through-holes passing from the first surface to the second surface, and at least one opening passing from the first surface to the second surface. A plurality of tines are disposed on the terminal portion. Each tine extends through a corresponding one of the through holes in a direction from the first surface toward the second surface. At least one protrusion is disposed on the housing, extending at least partially through the respective at least one opening in the direction from the first surface toward the second surface. The at least one protrusion engages the tine plate along a perimeter of the at least one opening at two or more contact points.

According to one particular embodiment of the invention, the tine plate comprises a pair of openings passing from the first surface to the second surface. A pair of protrusions are disposed on the housing, each corresponding to one of the openings. Each protrusion extends through its corresponding opening in the direction from the first surface toward the second surface, and each protrusion engages the tine plate along a perimeter of its corresponding opening at two or more contact points. Each protrusion includes a flange extending outwardly of the perimeter of the corresponding opening to latch on the tine plate. Another protrusion is disposed on the housing, having a flange to latch on an outer edge of the tine plate. The pair of openings are spaced from a line of symmetry passing through the another protrusion. At least one slot extends between the pair of openings for absorbing a deforming stress applied to the tine plate.

According to another aspect of the invention, a method of manufacturing a connector is provided. The method comprises securing a terminal portion on a housing. A tine plate is formed having a first surface, an oppositely facing second surface, a plurality of through-holes passing from the first surface to the second surface, and at least one opening passing from the first surface to the second surface. A plurality of tines and a plurality of terminals are disposed on the terminal portion, and each tine is placed in electrical communication with a respective one of the terminals. Each tine is passed through a corresponding one of the through holes in a direction from the first surface toward the second surface. At least one protrusion is formed on the housing. The protrusion is passed at least partially through the respective at least one opening in the direction from the first surface toward the second surface, thereby engaging the tine plate along a perimeter of the at least one opening at two or more contact points.

Other aspects and advantages of the invention will be apparent from the following description and claims.

DETAILED DESCRIPTION

The invention is described with reference to an exemplary embodiment illustrated in the attached drawings and made in accordance with a corresponding method of the invention.

Figure 1:
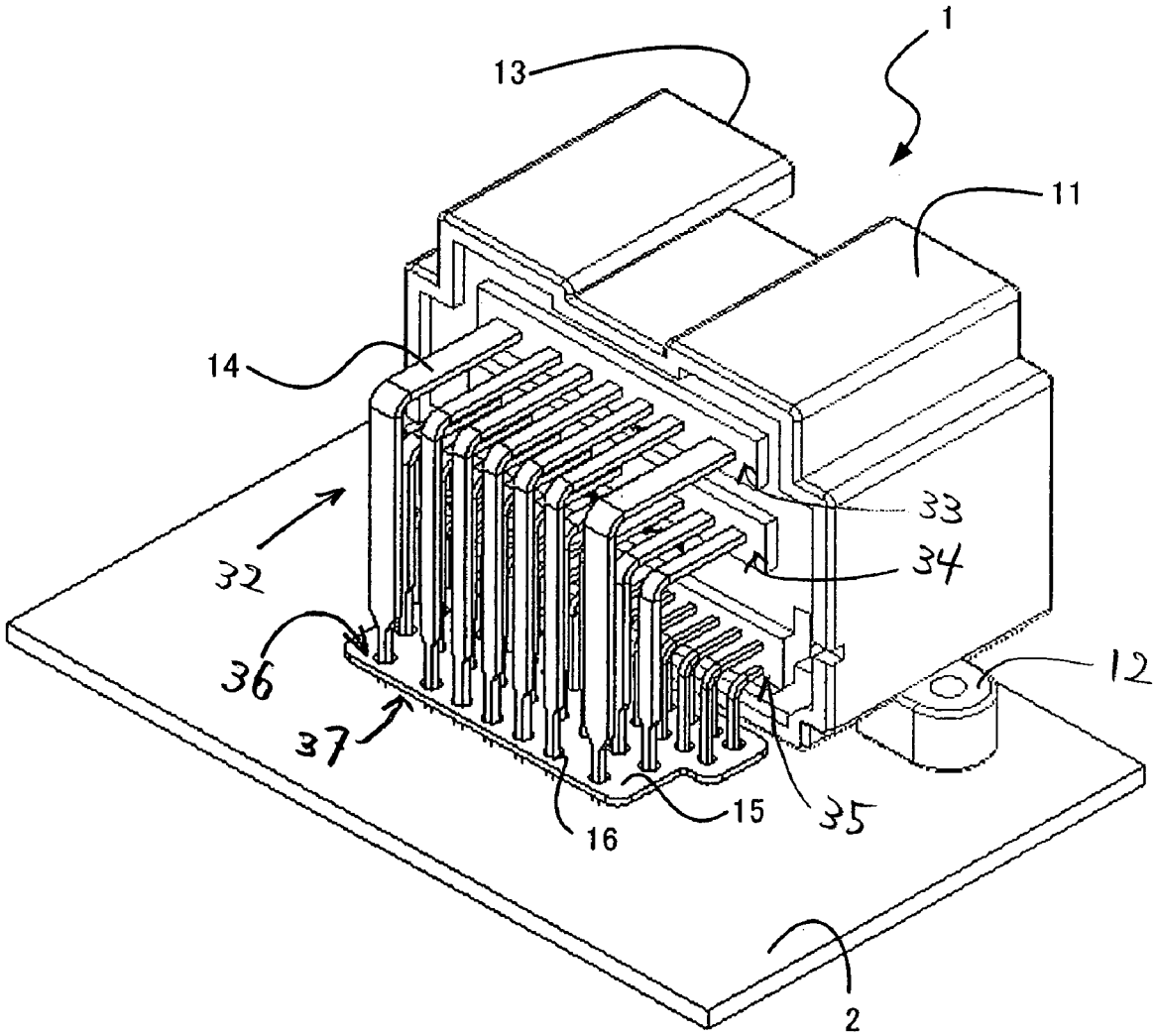
FIG. 1 shows a perspective view of an electrical connector with a tine plate in accordance with one embodiment of the present invention.

FIG. 1 shows a perspective view of an electrical connector 1 in accordance with an embodiment of the present invention. As shown in FIG. 1, the connector 1 is supported by leg portions 12 that are disposed on a bottom surface 31 of a connector housing 11, and mounted to a printed circuit board 2. The connector 1 comprises a receiving portion 13 at a front surface 30 thereof, and a plurality of tines 14 in series at a back surface 32 thereof. The connector 1 is generally of the right angle header type. Terminals of the receiving portion 13 are electrically connected to corresponding tines 14 passing through the housing 11, which allows power to be supplied to the print circuit board 2, and electrical signals to be transferred to and from the printed circuit board 2.

Tine plate 15 has a first surface 36 and an oppositely facing second surface 37, with respect to which positioning and orientation of various features may be described. Because tine plate 15 is typically a flat plate, such as may be manufactured by stamping sheet metal, the first surface 36 is substantially parallel to the second surface 37. Non-parallel configurations of first and second tine plate surfaces may be possible in some embodiments, however, without departing from the invention. A plurality of through holes 16 extend from the first surface 36 to the second surface 37.

Figure 2:
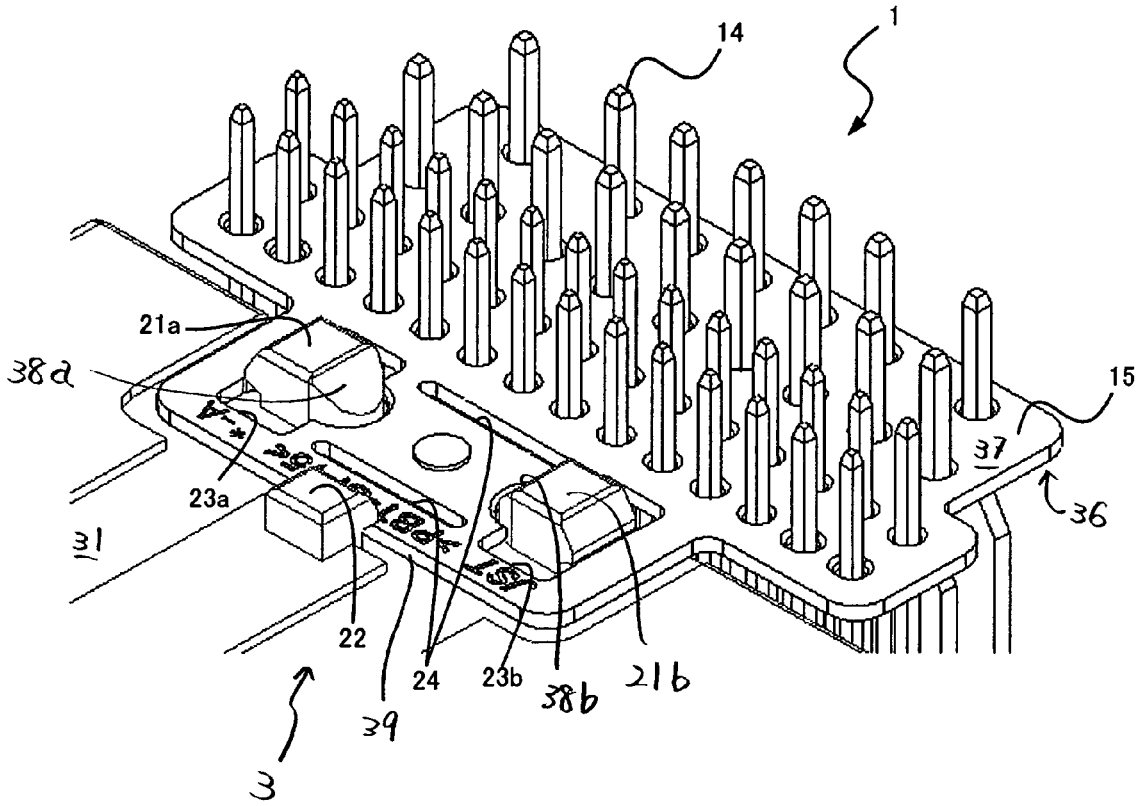
FIG. 2 shows a partially elongated perspective view directed toward the bottom of an electrical connector with a tine plate in accordance with one embodiment of the present invention.

The plurality of tines 14 are formed in an inverted L shape, such that the tines 14 extend horizontally from the back surface of the housing 11 and bend at a right angle toward the first surface 36 of the tine plate 15 and through the through holes 16 to reach electrode pads (not shown in FIG. 1) of the printed circuit board 2. In the connector 1 as shown in FIG. 1, the tines 14 become progressively shorter from upper rows 33 to lower rows 34 and 35. The tines 14 may also be of different sizes and cross-sectional shapes. For example, the tines 14 in row 33 generally have larger cross sections than those in lower row 34, and tines 14 in row 34 generally have larger cross sections than those in lower row 35. The tines 14 pass all the way through the tine plate 15 to extend beyond second surface 37, as illustrated in FIG. 2. The tips of the tines 14 passing through the through-holes 16 are solder-mounted thereto. The tine plate 15 helps prevent deformation of each of the tines 14 and also ensures proper alignment and contact between the tines 14 and the electrode pads.

The tine plate 15 is attached to the bottom surface of the housing 11 by a locking mechanism generally indicated at 3 and illustrated in FIGS. 2–6. FIG. 2 shows a partially elongated perspective view of the connector 1. The locking mechanism 3 comprises a pair of similar protrusions 21*a* and 21*b*, and another protrusion 22, which are disposed on the bottom surface 31 of the housing 11. The tine plate 15 has a pair of openings 23*a* and 23*b* configured to receive the corresponding protrusions 21*a* and 21*b*, respectively. Each protrusions 21*a* and 21*b* frictionally engages the tine plate 15 at perimeter portions of corresponding opening 23*a*, 23*b* at two contact points T.

A pair of slots 24 are configured to separate or absorb deforming stress applied to the tine plate 15, such as an external force applied by the housing 11 or an internal force due to thermal expansion. For example, excessive heat may induce a stress on the tine plate 15, and the slots 24 may allow elastic deformation to accommodate the stress to reduce the stress on the tine plate 15 in the vicinity of the through holes 16. The tine plate 15 is preferably oriented as shown, with the openings 23*a* and 23*b* (and the corresponding protrusions 25*a* and 25*b*) evenly spaced from and symmetrical with respect to a reference symmetry line 25 or plane drawn in FIG. 6 through the protrusion 22. The slots 24 are shown perpendicular to and centered on symmetry line 25, to more uniformly absorb any stresses induced in the tine plate 15.

Figures 3, 4:
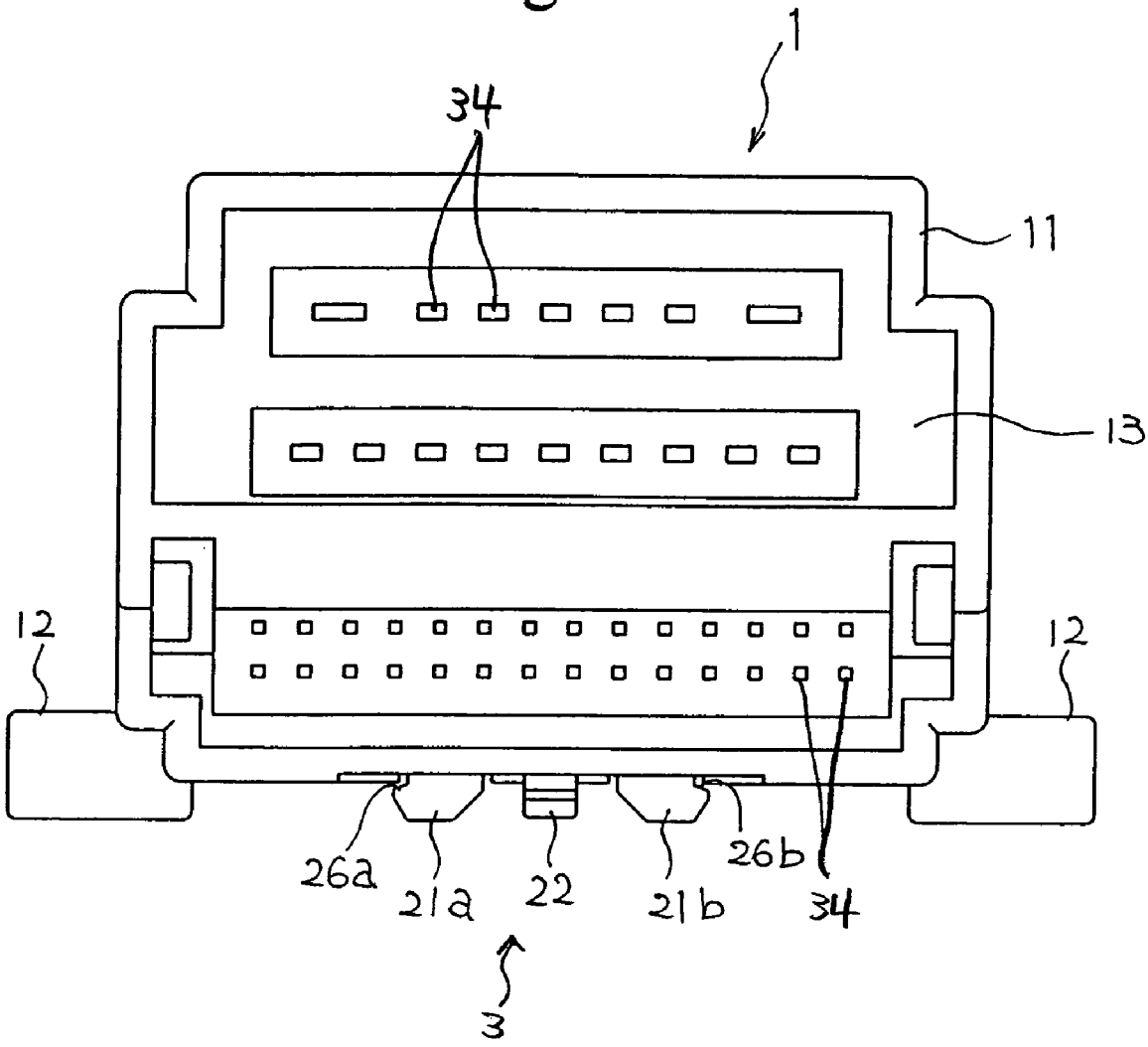
FIG. 3 shows a front view of a body of an electrical connector in accordance with one embodiment of the present invention.
FIG. 4 shows a bottom view of a body of an electrical connector in accordance with one embodiment of the present invention.
Figure 5:
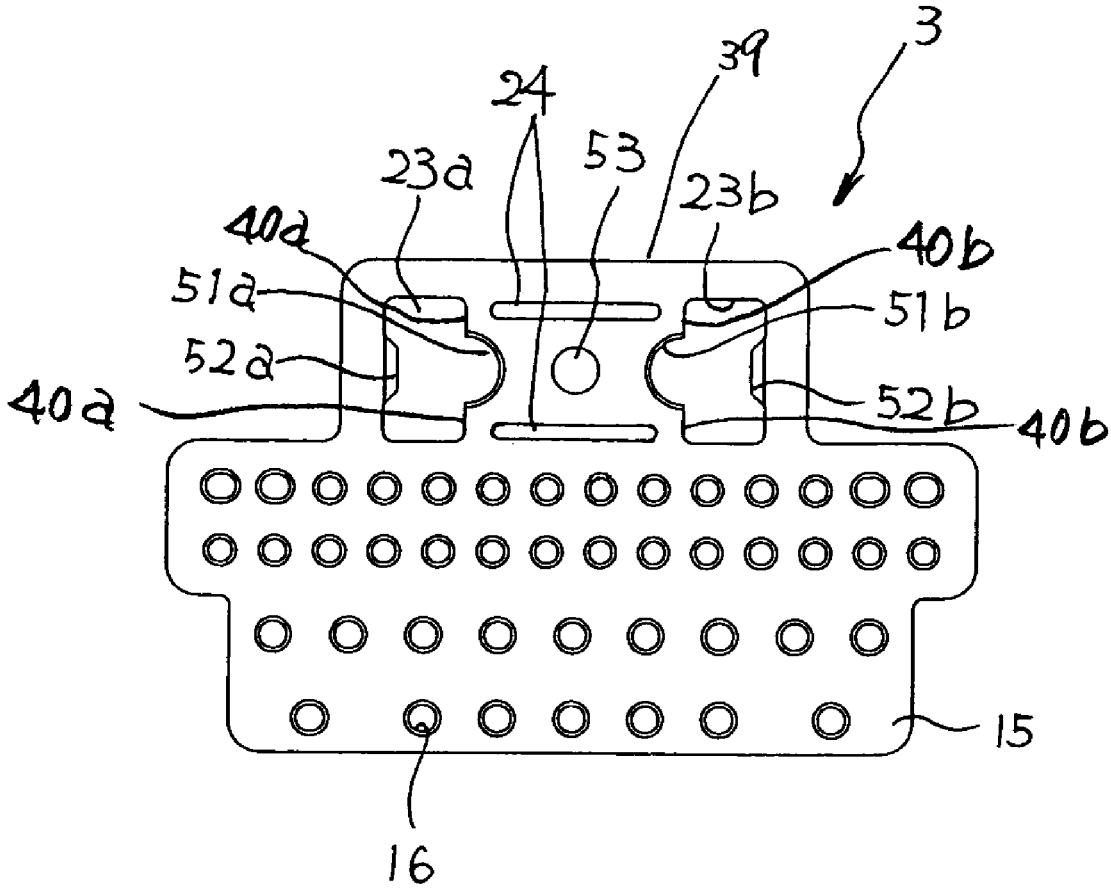
FIG. 5 shows a tine plate in accordance with one embodiment of the present invention.
Figure 6:
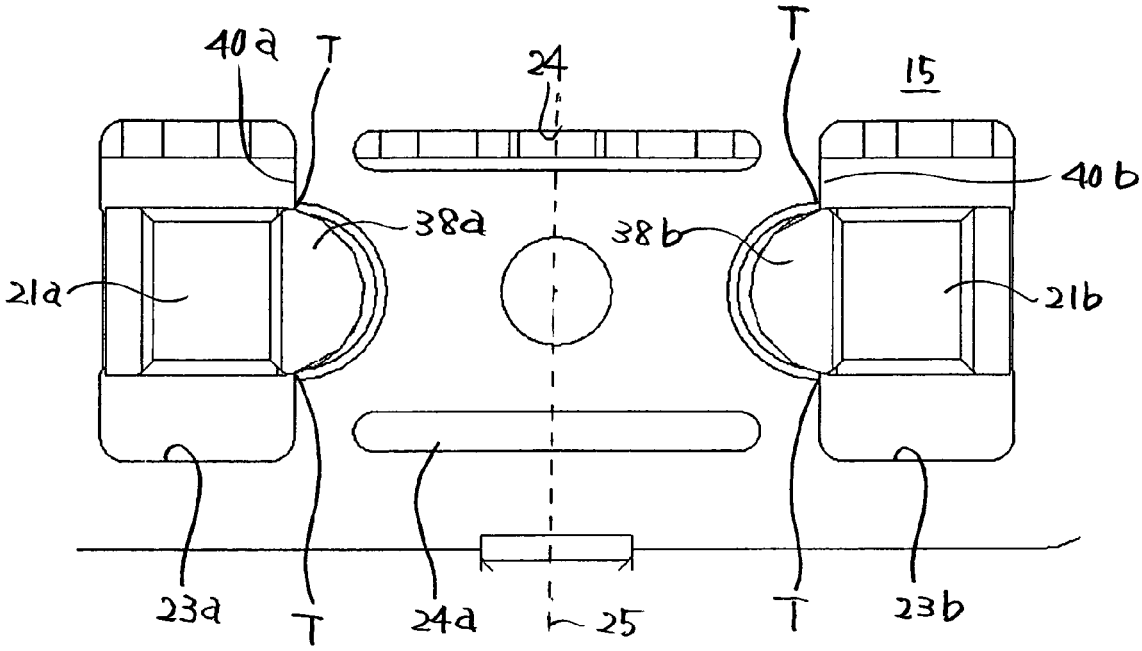
FIG. 6 shows a partially elongated bottom view of an electrical connector with a tine plate in accordance with one embodiment of the present invention.
Figure 7:
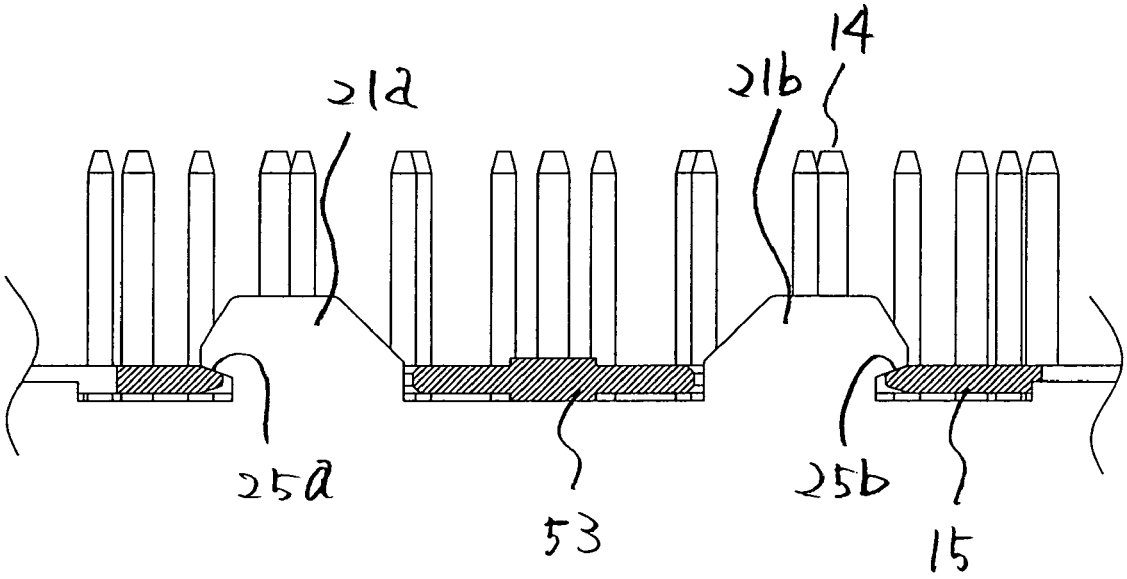
FIG. 7 shows a partial cross-sectional view of an electrical connector with a tine plate in accordance with one embodiment of the present invention.

A configuration of the locking mechanism 3 is further illustrated in FIGS. 3–7. FIG. 3 shows a plan view of a body of the connector 1 in accordance with this specific embodiment, and FIG. 4 shows a bottom view of the connector body. Thus, it is noted that the tine plate 15 is removed for illustrating the locking mechanism 3 in FIGS. 3 and 4. FIG. 5 shows the tine plate 15 engaged with the locking mechanism 3. FIG. 6 shows a partially elongated bottom view of the connector 1 to illustrate the tine plate 15 attached to the housing 11. FIG. 7 shows a partial cross-sectional view of the connector to illustrate the locking mechanism 3.

Referring to FIGS. 3 and 4, the pair of protrusions 21*a* and 21*b* and another protrusion 22 are centrally located on the bottom surface 31 of the housing 11. In this embodiment, as is apparent from FIG. 4, the protrusion 22 is disposed at an apex of an isosceles triangle 41 defined by the positions of protrusions 21*a*, 21*b*, and 22 in view of molding process. In other words, protrusions 21*a* and 21*b* are spaced from symmetry line 25 (which is oriented in a "Y-axis direction"), outward of the protrusion 22. This makes it possible to use a two-way molding method to manufacture the housing 1.

The protrusions 21*a* and 21*b* include arcuate portions 38*a* and 38*b*, which in the embodiment shown are substantially semi-circular and may be alternatively referred to as "semi-circular portions" 38*a*, 38*b*. Each of the arcuate portions 38*a*, 38*b* meet corresponding arcuate portions 51*a*, 51*b* of the openings 23*a*, 23*b*, as shown in FIG. 5. Arcuate portions 51*a*, 51*b* in the embodiment shown are substantially semi-circular, and may be alternatively referred to as "semi-circular portions" 51*a*, 51*b*. The semi-circular portions 51*a* and 51*b* may be chamfered. The size and shape of each arcuate portions 38*a*, 38*b* is slightly different from that of corresponding openings 23*a*, 23*b* such that they may contact each other at two contact points T. In some embodiments, there may be more than two contact points, but the contact points should be spaced from one another along a perimeter of the arcuate portions 51*a*, 51*b*, rather than an essentially "infinite" number of contact points that would result from continuous contact between arcuate portions 38*a*, 38*b* and arcuate portions 51*a*, 51*b*. So long as two or more contact points are achieved, various configurations may be selected without departing from the invention, as will be described later.

Returning to FIG. 3, the tapered flange portions 26*a* and 26*b* taper inwardly in the direction from the first surface 36 toward the second surface 37. In this embodiment, each of the flange portions 26*a* and 26*b* is disposed opposite each of the semicircular-shaped portions 38*a*, 38*b* thereof. The protrusion 22 also comprises a tapered flange portion 27. The flange portion 26*a*, 26*b* extend outwardly of a perimeter of the openings 23*a*, 23*b*, to latch against the tine plate 15. Tapered flange portion 27 extends inwardly from an outer edge 39 (FIG. 2) of the tine plate 15 to latch on the tine plate 15. During installation of the tine plate 15, the tapered portion of protrusions 21*a*, 21*b* and 22 are engaged by the plate to wedge them outwardly until the protrusions extend past the second surface 37, at which point they may "snap" back to latch against the tine plate 15. Accordingly, the locking mechanism 3 can prevent undesirable separation of the housing 11 from the tine plate 15.

Referring to FIG. 5, the tine plate 15 preferably further includes recessed detents 52*a* and 52*b* extending to the corresponding openings 23*a* and 23*b*. The flange portions 26*a* and 26*b* latch against the detents 52*a* and 52*b*, preventing the separation of the tine plate 15 in a Z-axis direction orthogonal to the first surface 36 of the plate 15. Furthermore, because the semicircular-shaped portions 51*a* and 51*b* frictionally engage the semicircular-shaped portions of the protrusions 21*a* and 21*b* at two or more contact points, the locking mechanism 3 further restrain rotational movement of the tine plate 15 in an X-Y plane. In some embodiments, the shape, size, and relationship between the flange portions 26*a* and 26*b* and the openings 23*a* and 23*b* may be selected such that the detents 52*a* and 52*b* may be omitted, in which case the flange portions 26*a*, 26*b* may latch directly onto the second surface 37 of the tine plate 15.

To further constrain motion of the tine plate 15, a boss or raised portion 53 is disposed on the tine plate 15, preferably between the opening 23*a* and 23*b* and the slots 24 as shown. The boss 53 extends toward the bottom surface of the housing 11, and thus restrains movement of the tine plate 15 toward the housing 11 in a vertical or Z-axis direction. The boss 53 may be configured on both surfaces 36, 37 of the tine plate 15 such that the tine plate 15 can be used reversibly. Two or more bosses 53 may be configured on at least one surface 36, 37 of the tine plate 15. The boss 53 is not limited to being circular. The boss or raised portion may alternatively be disposed on the bottom surface of the housing 11, extending toward the tine plate 15.

During installation, the tine plate 15 is oriented such that the tines 14 are aligned with the respective through-holes 16. Subsequently, the tine plate 15 is mounted on the bottom surface of the housing 11 by passing the plurality of tines 14 through the plurality of through-holes 16. Because the flange portions 26*a* and 26*b* of the protrusions 21*a* and 21*b* extend outwardly of the perimeter of the opening 23*a* and 23*b* of the tine plate 15, and because the flange portion 27 of the protrusion 22 extends inwardly of the edge portion of tine plate 15, the tine plate 15 must be urged toward the housing 11, to elastically deform the protrusions 21*a*, 21*b*, and 22 against the corresponding edge portions of tine plate 15 until fully latched. The tine plate 15 is thereby engaged with the semicircular-shaped portions 38*a*, 38*b* of the protrusions 21*a* and 21*b* at the two contact points T. The tine plate 15 is thus secured to the housing 11 and restrained by the flange portions 26*a*, 26*b*, and 27, and further due to the boss 53 being in close contact with the bottom surface of the housing 11.

The protrusions 21*a* and 21*b* engage the openings 23*a* and 23*b* of the tine plate 15 at two contact points T, restraining rotational movement of tine plate 15 in the X-Y plane. Specifically, as shown in FIG. 6, each semicircular-shaped portions 38, 38*b* of the protrusions 21*a* and 21*b* is in contact with points T proximate to intersections of arcuate portions 51*a*, 51*b* with adjacent edges 40*a*, 40*b* of the openings 23*a*, 23*b* of the tine plate 15. Contact at discrete contact points T minimizes interference of the protrusions 21*a* and 21*b* with the tine plate 15. Further, by selecting the two contact points T and the amount of interference, it is possible to control the amount of interference of the protrusions 21*a* and 21*b* with the tine plate 15.

Figure 8A:
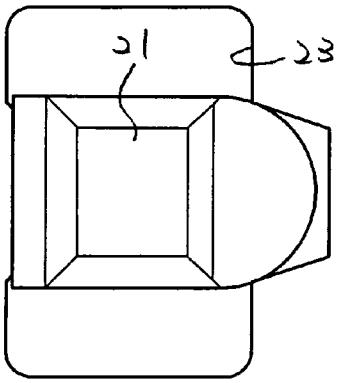
FIGS. 8A through 8E illustrate different embodiments of connectors having protrusions and openings of various shapes and configurations.
Figure 8B:
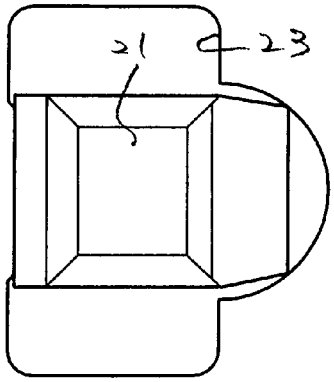
Figure 8C:
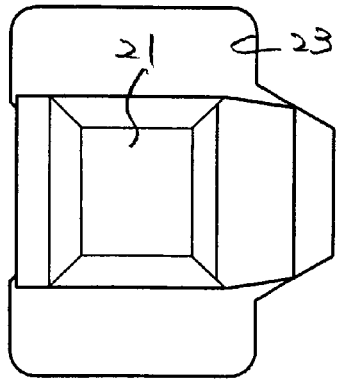
Figure 8D:
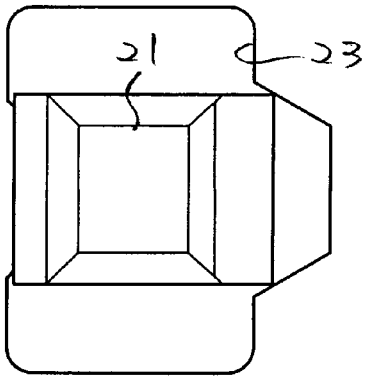
Figure 8E:
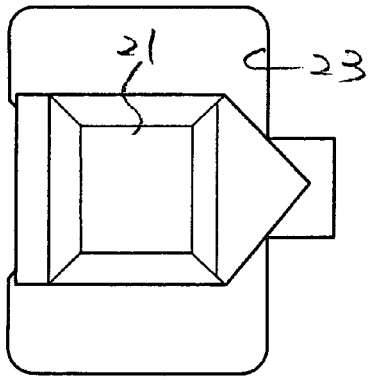

Although the embodiments discussed above achieve two or more contact points by virtue of arcuate portions of differing curvature, those of ordinary skill in the art will appreciate that this configuration may be modified without departing from the scope of the invention. For example, as shown in FIGS. 8A–8E, the two contact points may be achieved by a variety of configurations. For example, either of the protrusions 21*a* and 21*b* or the openings 23*a* and 23*b* of the tine plate 15 may have rectangular portions. Alternatively, as shown in FIGS. 8C and 8D, the protrusions 21*a* and 21*b* may be configured to have rectangular or trapezoidal portions and to engage the straight edges of openings 23*a* and 23*b*, which are formed in trapezoidal shapes, with the corners of the rectangular or trapezoidal portions of the protrusions 21*a* and 21*b*. Otherwise, as shown in FIG. 8E, the protrusions 21*a* and 21*b* may be configured to have triangle portions.

Several advantages result from the present invention, some of which have been discussed above. For example, according to one or more embodiments, because protrusions disposed on a housing frictionally engage a tine plate at two or more discrete contact points, rotational movement of the tine plate in an XY plane can be restrained. Because one or more flange portions of protrusions latch on the tine plate, translational motion in the X, Y, and Z directions is restrained, preventing inadvertent separation of the tine plate. The boss formed on the tine plate or the housing that bridges a gap between the tine plate and the housing limits movement of the tine plate toward the housing, thereby controlling the amount of clearance between the tine plate and the housing. A related advantage is that the positioning of the tines is enhanced, and the tines are better protected as a result.

While the invention has been described with respect to a limited number of embodiments, those skilled in the art having benefit of this disclosure will appreciate that other embodiments can be devised which do not depart from the scope of the invention as disclosed herein. Accordingly, the scope of the invention should be limited only by the attached claims.

What is claimed is:

1. A connector comprising:

a housing;

a terminal portion disposed on the housing;

a tine plate having a first surface, an oppositely facing second surface, a plurality of through holes passing from the first surface to the second surface, and at least one opening passing from the first surface to the second surface;

a detent recessed into the second surface and extending to the at least one opening;

a plurality of tines disposed on the terminal portion, each tine extending through a corresponding one of the through holes in a direction from the first surface toward the second surface; and at least one protrusion disposed on the housing and extending at least partially through the respective at least one opening in the direction from the first surface toward the second surface, the at least one protrusion engaging the tine plate along a perimeter of the at least one opening at two or more contact points, wherein the connector is capable of being mounted on a substrate.

2. The connector according to claim 1, wherein the at least one protrusion comprises:

a flange adjacent to the second surface and extending outwardly of the perimeter of the at least one opening to latch on the tine plate.

3. The connector according to claim 2, further comprising:

a boss secured to one of the housing and the tine plate, the boss configured to bridge a gap between the housing and the tine plate when the flange is latched.

4. The connector according to claim 2, wherein the tine plate further comprises:

the flange of the at least one protrusion latching onto the detent of the tine plate.

5. The connector according to claim 1, wherein the at least one protrusion comprises an arcuate portion configured to engage the tine plate at the two or more contact points.

6. The connector according to claim 5, wherein the perimeter of the at least one opening comprises:

an arcuate portion corresponding to the arcuate portion of the at least one protrusion.

7. The connector according to claim 6, wherein a curvature of the arcuate portion of the at least one protrusion is different from a curvature of the arcuate portion of the at least one opening.

8. The connector according to claim 1, further comprising:

at least one slot passing through the tine plate, the at least one slot spaced from the at least one opening for absorbing a deforming stress applied to the tine plate.

9. The connector according to claim 1, wherein the at least one protrusion further comprises:

a tapered portion tapering inwardly in the direction from the first surface toward the second surface, the tapered portion configured to engage the plate at the perimeter of the at least one opening.

10. The connector according to claim 1, wherein the tines bend at substantially 90 degrees between the terminal portion and the tine plate.

11. A connector:

a housing;

a terminal portion disposed on the housing;

a tine plate having a first surface, an oppositely facing second surface, a plurality of through-holes passing from the first surface to the second surface, and at least one opening passing from the first surface to the second surface;

a detent recessed into the second surface and extending to the at least one opening:

a plurality of tines disposed on the terminal portion, each tine extending through a corresponding one of the through holes in a direction from the first surface toward the second surface;

at least one protrusion disposed on the housing and extending at least partially through the respective at least one opening in the direction from the first surface toward the second surface, the at least one protrusion engaging the tine plate along a perimeter of the at least one opening at two or more contact points; and another protrusion disposed on the housing and having a flange to latch on an outer edge of the tine plate, and wherein the connector is capable of being mounted on a substrate.

12. The connector according to claim 11, wherein a pair of openings is disposed to be spaced from a line of symmetry passing through the other protrusion.

13. The connector according to claim 12, wherein the pair of openings are symmetrically oriented with respect to the line of symmetry.

14. The connector according to claim 12, further comprising:

at least one slot through the tine plate traversing the line of symmetry for absorbing a deforming stress applied to the tine plate.

15. A connector comprising:

a housing;

a terminal portion disposed on the housing;

a tine plate having a first surface, an oppositely facing second surface, a plurality of through-holes passing from the first surface to the second surface, and a pair of openings passing from the first surface to the second surface;

a plurality of tines disposed on the terminal portion, each tine extending through a corresponding one of the through holes in a direction from the first surface toward the second surface, each tine in electrical communication with a respective terminal disposed on the terminal portion;

a pair of protrusions disposed on the housing corresponding to the pair of openings, each protrusion extending at least partially through its corresponding opening in the direction from the first surface toward the second surface, each protrusion engaging the tine plate along a perimeter of its corresponding opening at two or more contact points, each protrusion including a flange extending outwardly of the perimeter of the corresponding opening to latch on the tine plate;

a pair of detents, each detent recessed into the second surface and extending to a corresponding one of the opening;

another protrusion disposed on the housing and having a flange to latch on an outer edge of the tine plate, the pair of openings spaced from a line of symmetry passing through the another protrusion; and at least one slot extending between the pair of openings for absorbing a deforming stress applied to the tine plate.

16. The connector according to claim 15, further comprising:

each protrusion including an arcuate portion; and each opening including an arcuate portion having a curvature different than the curvature of the corresponding protrusion, the two or more contact points being positioned between the arcuate portion of the opening and the arcuate portion of the corresponding protrusion.

17. The connector according to claim 15, further comprising:

a boss secured to one of the housing and the tine plate, the boss configured to bridge a gap between the housing and the tine plate when the flange is latched.

18. The connector according to claim 15, wherein each flange is configured to latch onto the corresponding detent.

19. The connector according to claim 15, wherein the pair of openings are symmetrically oriented with respect to the line of symmetry.

20. A method of manufacturing a connector, the method comprising:

securing a terminal portion on a housing;

forming a tine plate having a first surface, an oppositely facing second surface, a plurality of through-holes passing from the first surface to the second surface, at least one opening passing from the first surface to the second surface and a detent recessed into the second surface and extending to the at least one opening;

disposing a plurality of tines and a plurality of terminals on the terminal portion and placing each tine in electrical communication with a respective one of the terminals;

passing each tine at least partially through a corresponding one of the through holes in a direction from the first surface toward the second surface; and forming at least one protrusion on the housing and passing the protrusion at least partially through the respective at least one opening in the direction from the first surface toward the second surface, thereby engaging the tine plate along a perimeter of the at least one opening at two or more contact points, wherein the connector is capable of being mounted on a substrate.

* * * * *